US011255171B2

(12) United States Patent
Lane et al.

(10) Patent No.: US 11,255,171 B2
(45) **Date of Patent: *Feb. 22, 2022**

(54) METHOD OF PUMPING FLUID FROM A WELLBORE BY A SUBSURFACE PUMP HAVING AN INTERIOR FLOW PASSAGE IN COMMUNICATION WITH A FLUID CHAMBER VIA A FILTER POSITIONED IN A SIDE WALL OF A PLUNGER

(71) Applicant: WEATHERFORD TECHNOLOGY HOLDINGS, LLC, Houston, TX (US)

(72) Inventors: William C. Lane, The Woodlands, TX (US); Douglas Hebert, Cypress, TX (US); John Stachowiak, Jr., Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,452

(22) Filed: May 14, 2019

(65) Prior Publication Data

US 2019/0264549 A1 Aug. 29, 2019

Related U.S. Application Data

(63) Continuation of application No. 15/299,978, filed on Oct. 21, 2016, now Pat. No. 10,385,663.

(51) Int. Cl.
*F04B 47/02* (2006.01)
*E21B 34/06* (2006.01)
(Continued)

(52) U.S. Cl.
CPC ..... *E21B 43/126* (2013.01); *E21B 34/06* (2013.01); *E21B 43/127* (2013.01); *F04B 47/02* (2013.01);
(Continued)

(58) Field of Classification Search
CPC .... F04B 47/0056; F04B 47/02; F04B 47/026; F04B 53/02; F04B 7/0266; F04B 7/04;
(Continued)

(56) References Cited

U.S. PATENT DOCUMENTS 1,313,245 A * 8/1919 Andrews ..... F04B 49/065 417/53
1,545,475 A * 7/1925 Adams ..... F04B 53/126 417/430
(Continued)

FOREIGN PATENT DOCUMENTS

EP 2818630 A1 12/2014

OTHER PUBLICATIONS

Weatherford; "Sand Pumps, Parts and Accessories", pp. 63-74 of company article No. 4648.02, dated 2008-2012, 12 pages.
(Continued)

*Primary Examiner* — Kenneth J Hansen
*Assistant Examiner* — Benjamin Doyle
(74) *Attorney, Agent, or Firm* — Smith IP Services, P.C.

(57) ABSTRACT

A pump can include a plunger and a barrel, at one stroke extent flow being substantially restricted between the plunger and the barrel at spaced apart positions and a plunger interior passage in filtered communication with a fluid chamber between the positions, and at an opposite stroke extent the fluid chamber being in communication with the standing valve. A method can include displacing a plunger in one direction, thereby receiving filtered liquid into a fluid chamber, and b) displacing the plunger in an opposite direction, thereby transferring the liquid to a barrel interior passage. A system can include an actuator that reciprocates a rod string, and a pump including a plunger with a traveling valve, a barrel with a standing valve, and a filter that filters liquid which flows from a tubing string to a
(Continued)

compression chamber disposed between the traveling valve and the standing valve.

14 Claims, 5 Drawing Sheets

(51) Int. Cl.
*F04B 19/22* (2006.01)
*F04B 53/20* (2006.01)
*E21B 43/12* (2006.01)
*F04B 53/14* (2006.01)

(52) U.S. Cl.
CPC ..... *F04B 47/026* (2013.01); *E21B 2200/04* (2020.05); *F04B 19/22* (2013.01); *F04B 53/143* (2013.01); *F04B 53/20* (2013.01)

(58) Field of Classification Search
CPC ..... F04B 19/22; F04B 23/02–023; F04B 39/0016; F04B 47/04; F04B 47/12; F04B 53/1002–1005; F04B 53/14; F04B 53/16–162; E21B 43/126; E21B 34/06; E21B 43/127; E21B 2034/002
USPC ..... 417/313, 430, 126, 398–401, 415–417, 417/456–459, 490, 495, 545, 554, 417/555.1–555.2, 559, 567; 92/78, 79
See application file for complete search history.

(56) References Cited

U.S. PATENT DOCUMENTS 1,549,175 A * 8/1925 Reilly ..... F04B 47/02 417/258
2,905,099 A * 9/1959 Turner ..... F04B 47/00 166/68
3,106,526 A 10/1963 Schmidt
3,479,958 A * 11/1969 Anderson ..... F04B 47/00 417/437
3,594,103 A * 7/1971 Hillis ..... F04B 53/162 417/425
3,861,471 A * 1/1975 Douglas ..... E21B 43/12 166/369
3,953,155 A * 4/1976 Roeder ..... F04B 53/126 417/554
4,968,226 A * 11/1990 Brewer ..... F04B 47/02 417/435
5,653,286 A * 8/1997 McCoy ..... E21B 43/38 166/105.5
6,273,690 B1 * 8/2001 Fischer, Jr ..... F04B 47/026 417/553
6,568,477 B1 5/2003 Dveyrin
7,458,787 B2 * 12/2008 Brown ..... F04B 47/02 166/105
7,891,960 B2 * 2/2011 Lea, Jr. ..... F04B 47/022 417/552
8,066,496 B2 * 11/2011 Brown ..... E21B 43/127 166/105
8,858,187 B2 10/2014 Lane
10,385,663 B2 * 8/2019 Lane ..... F04B 47/026
2004/0060705 A1 * 4/2004 Kelley ..... E21B 43/38 166/372
2005/0129547 A1 * 6/2005 Burns ..... E21B 37/00 417/555.1
2007/0272404 A1 * 11/2007 Lynde ..... E21B 47/18 166/99
2010/0215528 A1 * 8/2010 Fisher ..... E21B 43/127 417/456
2011/0073319 A1 * 3/2011 Wilson ..... E21B 43/127 166/372
2012/0080199 A1 * 4/2012 Wilson ..... E21B 43/127 166/372
2013/0039780 A1 * 2/2013 Lane ..... F04B 53/20 417/53
2017/0096877 A1 * 4/2017 Tolman ..... E21B 43/121
2017/0159384 A1 * 6/2017 Romer ..... E21B 23/10
2017/0167237 A1 * 6/2017 Romer ..... F04B 43/02
2018/0112503 A1 * 4/2018 Lane ..... E21B 34/06
2018/0298736 A1 * 10/2018 Bailey ..... E21B 43/126
2018/0313347 A1 * 11/2018 Tolman ..... F04B 45/027

OTHER PUBLICATIONS

Weatherford; "Run 5.5x longer with sand-tolerant pumps", company article No. 11512.01, dated 2015, 6 pages.
Office Action dated Sep. 28, 2018 for U.S. Appl. No. 15/299,978, 31 pages.
Mexican Office Action dated Aug. 26, 2021 for MX Patent Application No. MX/a/2017/013550, 3 pages, Document 2 is the assumed English translation of Document 1.
English translation of Mexican Office Action dated Aug. 26, 2021 for MX Patent Application No. MX/a/2017/013550, 3 pages.
Colombian Office Action dated Apr. 1, 2020 for CO Patent Application No. NC2017/0010661, 8 pages.
English Translation of Colombian Office Action dated Apr. 1, 2020 for CO Patent Application No. NC2017/0010661, 7 pages.
Colombian Office Action dated Sep. 1, 2020 for CO Patent Application No. NC2017/0010661, 11 pages.
English Translation of Colombian Office Action dated Sep. 1, 2020 for CO Patent Application No. NC2017/0010661, 10 pages.
Argentine Office Action dated Oct. 8, 2020 for AR Patent Application No. 20170102938, 3 pages.
English Translation of Argentine Office Action dated Oct. 8, 2020 for AR Patent Application No. 20170102938, 1 page.
Colombian Office Action dated Feb. 2, 2021 for CO Patent Application No. NC2017/0010661, 9 pages.
English Translation of Colombian Office Action dated Feb. 2, 2021 for CO Patent Application No. NC2017/0010661, 9 pages.
Colombian Office Action dated May 21, 2021 for CO Patent Application No. NC2017/0010661, 13 pages.
English Translation of Colombian Office Action dated May 21, 2021 for CO Patent Application No. NC2017/0010661, 17 pages.

* cited by examiner

METHOD OF PUMPING FLUID FROM A WELLBORE BY A SUBSURFACE PUMP HAVING AN INTERIOR FLOW PASSAGE IN COMMUNICATION WITH A FLUID CHAMBER VIA A FILTER POSITIONED IN A SIDE WALL OF A PLUNGER

CROSS-REFERENCE TO RELATED APPLICATION

This application is a continuation of prior application Ser. No. 15/299,978 filed on 21 Oct. 2016. The entire disclosure of this prior application is incorporated herein by this reference.

BACKGROUND

This disclosure relates generally to equipment utilized and operations performed in conjunction with a subterranean well and, in one example described below, more particularly provides an artificial lift pump suitable for pumping fluids with entrained gas and particulates.

Reservoir fluids can sometimes flow to the earth's surface when a well has been completed. However, with some wells, reservoir pressure may be insufficient (at the time of well completion or thereafter) to lift the fluids (in particular, liquids) to the surface. In those circumstances, technology known as "artificial lift" can be employed to bring the fluids to or near the surface (such as, at a land-based wellsite, a subsea production facility or pipeline, a floating rig, etc.).

Various types of artificial lift technology are known to those skilled in the art. In one type of artificial lift, a subsurface pump is operated by reciprocating a string of "sucker" rods deployed in a well. An apparatus (such as, a walking beam-type pump jack or a hydraulic actuator) located at the surface can be used to reciprocate the rod string.

Therefore, it will be readily appreciated that improvements are continually needed in the arts of constructing and operating artificial lift systems. Such improvements may be useful for lifting oil, water, gas condensate or other liquids from wells, and may be particularly useful in situations in which the liquids are produced along with gas and particulates (such as sand, formation fines, proppant etc.).

DETAILED DESCRIPTION

Figure 1:
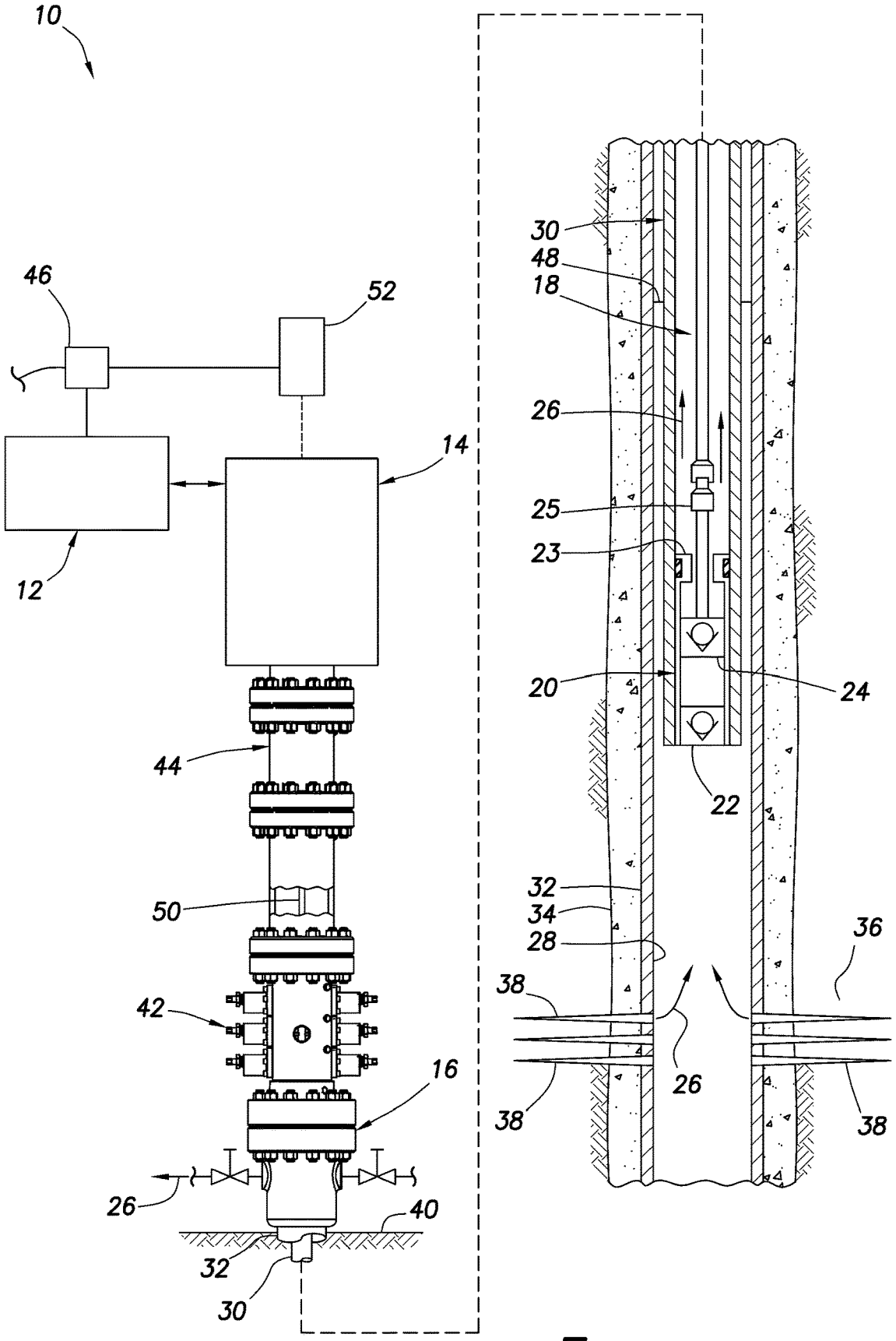
FIG. 1 is a representative partially cross-sectional view of an example of a well pumping system and associated method which can embody principles of this disclosure.

Representatively illustrated in FIG. 1 is a well pumping system 10 and associated method for use with a subterranean well, which system and method can embody principles of this disclosure. However, it should be clearly understood that the well pumping system 10 and method are merely one example of an application of the principles of this disclosure in practice, and a wide variety of other examples are possible. Therefore, the scope of this disclosure is not limited at all to the details of the system 10 and method as described herein or depicted in the drawings.

In the FIG. 1 example, a power source 12 is used to supply energy to an actuator 14 mounted on a wellhead 16. In response, the actuator 14 reciprocates a rod string 18 extending into the well, thereby operating a subsurface pump 20. In other examples, the rod string 18 could be reciprocated by other types of actuators (such as, a pump jack or walking-beam mechanism).

The rod string 18 may be made up of individual sucker rods connected to each other (although other types of rods or tubes may be used), the rod string 18 may be continuous or segmented, a material of the rod string 18 may comprise steel, composites or other materials, and elements other than rods may be included in the string. Thus, the scope of this disclosure is not limited to use of any particular type of rod string, or to use of a rod string at all.

It is only necessary in this example to communicate reciprocating motion of the actuator 14 to the subsurface pump 20, and it is therefore within the scope of this disclosure to use any structure capable of such transmission. In other examples, reciprocating motion may be produced downhole (such as, using a subsurface electrical or hydraulic actuator), and so it is not necessary for the actuator 14 to be positioned at surface, or for reciprocating motion to be communicated from surface to the subsurface pump 20.

The subsurface pump 20 is depicted in FIG. 1 as being of the type having a stationary or "standing" valve 22 and a reciprocating or "traveling" valve 24. The traveling valve 24 is connected to, and reciprocates with, the rod string 18, so that fluid 26 is pumped from a wellbore 28 into a production tubing string 30.

The subsurface pump 20 is depicted schematically in FIG. 1, but is preferably configured (as described more fully below), so that it is capable of reliably pumping the fluid 26 from the wellbore 28, even when the fluid 26 includes entrained gas and particulates. Various embodiments of the subsurface pump 20 are contemplated, and so the scope of this disclosure is not limited to any of the details of the subsurface pump 20 as described herein or depicted in the drawings.

The wellbore 28 is depicted in FIG. 1 as being generally vertical, and as being lined with casing 32 and cement 34. In other examples, a section of the wellbore 28 in which the pump 20 is disposed may be generally horizontal or otherwise inclined at any angle relative to vertical, and the wellbore section may not be cased or may not be cemented. Thus, the scope of this disclosure is not limited to use of the well pumping system 10 and method with any particular wellbore configuration.

In the FIG. 1 example, the fluid 26 originates from an earth formation 36 penetrated by the wellbore 28. The fluid 26 flows into the wellbore 28 via perforations 38 extending through the casing 32 and cement 34. The fluid 26 can comprise a liquid (such as oil, gas condensate, water, etc.), with entrained gas (such as hydrocarbon gas, steam, etc.) and particulates (such as sand, proppant, formation fines, etc.) However, the scope of this disclosure is not limited to use of the well pumping system 10 and method with any particular type or composition of the fluid 26, or to any particular origin of the fluid.

As depicted in FIG. 1, the casing 32 and the production tubing string 30 extend upward to the wellhead 16 at or near the earth's surface 40 (such as, at a land-based wellsite, a subsea production facility, a floating rig, etc.). The production tubing string 30 can be hung off in the wellhead 16, for example, using a tubing hanger (not shown in FIG. 1). Although only a single string of the casing 32 is illustrated in FIG. 1 for clarity, in practice multiple casing strings and optionally one or more liner strings (a liner string being a pipe that extends from a selected depth in the wellbore 28 to a shallower depth, typically sealingly "hung off" inside another pipe or casing) may be installed in the well.

In the FIG. 1 example, a rod blowout preventer stack 42 and a stuffing box 44 are connected between the actuator 14 and the wellhead 16. The rod blowout preventer stack 42 includes various types of blowout preventers (BOP's) configured for use with the rod string 18. For example, one blowout preventer can prevent flow through the blowout preventer stack 42 when the rod string 18 is not present therein, and another blowout preventer can prevent flow through the blowout preventer stack 42 when the rod string 18 is present therein. However, the scope of this disclosure is not limited to use of any particular type or configuration of blowout preventer stack with the well pumping system 10 and method of FIG. 1.

The stuffing box 44 includes an annular seal (not visible in FIG. 1) about an upper end of the rod string 18. A reciprocating rod 50 forms an upper section of the rod string 18 below the annular seal, although in other examples a connection between the rod 50 and the rod string 18 may be otherwise positioned.

In some examples, a rod of the type known to those skilled in the art as a "polished rod" suitable for sliding and sealing engagement within the annular seal in the stuffing box 44 may be connected above the rod 50. The polished rod may be a component of the actuator 14, such as, a rod extending downwardly from a piston of the actuator 14.

The power source 12 may be connected directly to the actuator 14, or it may be positioned remotely from the actuator 14 and connected with, for example, suitable electrical cables, mechanical linkages, hydraulic hoses or pipes. Operation of the power source 12 is controlled by a control system 46.

The control system 46 may allow for manual or automatic operation of the actuator 14 via the power source 12, based on operator inputs and measurements taken by various sensors. The control system 46 may be separate from, or incorporated into, the actuator 14 or the power source 12. In one example, at least part of the control system 46 could be remotely located or web-based, with two-way communication between the actuator 14, the power source 12 and the control system 46 being via, for example, satellite, wireless or wired transmission.

The control system 46 can include various components appropriate for use in controlling operation of the actuator 14 and the power source 12. A suitable control system is described in U.S. application Ser. No. 14/956,545 filed on 2 Dec. 2015. However, the scope of this disclosure is not limited to any particular type or configuration of the control system 46.

It can be advantageous to control a reciprocation speed of the rod string 18, instead of reciprocating the rod string 18 as fast as possible. For example, a liquid-gas interface 48 in the wellbore 28 can be affected by the flow rate of the fluid 26 from the well. The liquid-gas interface 48 could be an interface between gas and water, gas and gas condensate, gas and oil, steam and water, or any other fluids or combination of fluids.

If the flow rate is too great, the interface 48 may descend to below the stationary valve 22, so that eventually the pump 20 will no longer be able to pump a liquid component of the fluid 26 (a condition known to those skilled in the art as "pump-off"). On the other hand, it is typically desirable for the flow rate of the fluid 26 to be at a maximum level that does not result in pump-off. In addition, a desired flow rate of the fluid 26 may change over time (for example, due to depletion of a reservoir, changed offset well conditions, water or steam flooding characteristics, etc.).

A "gas-locked" subsurface pump 20 can result from a pump-off condition, or as a result of gas being entrained with the fluid 26, whereby gas is received into the subsurface pump 20. In a gas-locked pump 20, the gas is alternately expanded and compressed in the pump 20 as the traveling valve 24 reciprocates, but the fluid 26 cannot flow into or out of the subsurface pump 20, due to the gas therein.

"Gas interference" is a condition in which a volumetric efficiency of the subsurface pump 20 is reduced due to presence of a gas in the pump 20. Gas interference results in a reduction of compression in the subsurface pump 20, which delays opening of the traveling valve 24 on its downward stroke, as described more fully below. The subsurface pump 20 can mitigate the occurrence of gas interference and gas-locking.

In the FIG. 1 well pumping system 10 and method, the control system 46 can automatically control operation of the actuator 14 via the power source 12 to regulate the reciprocation speed and stroke extents of the rod string 18, so that any of various desirable objectives are achieved. The control system 46 may control operation of the actuator 14 in response to various inputs (such as real time measurements from sensors 52 that monitor various parameters). However, automatic reciprocation speed regulation by the control system 46 is not necessary in keeping with the scope of this disclosure.

For example, it is typically undesirable for a valve rod bushing 25 above the traveling valve 24 to impact a valve rod guide 23 above the standing valve 22 when the rod string 18 displaces downward (a condition known to those skilled in the art as "pump-pound"). Thus, it is preferred that the rod string 18 be displaced downward only until the valve rod bushing 25 is near its maximum possible lower displacement limit, so that it does not impact the valve rod guide 23.

On the other hand, the longer the stroke distance (without impact), the greater the productivity and efficiency of the pumping operation (within practical limits), and the greater the compression of fluid 26 between the standing and traveling valves 22, 24 (e.g., to avoid gas interference and gas-lock). In addition, a desired stroke of the rod string 18 may change over time (for example, due to gradual lengthening of the rod string 18 as a result of lowering of a liquid level in the well (such as, at the gas-liquid interface 48)).

Figure 2:
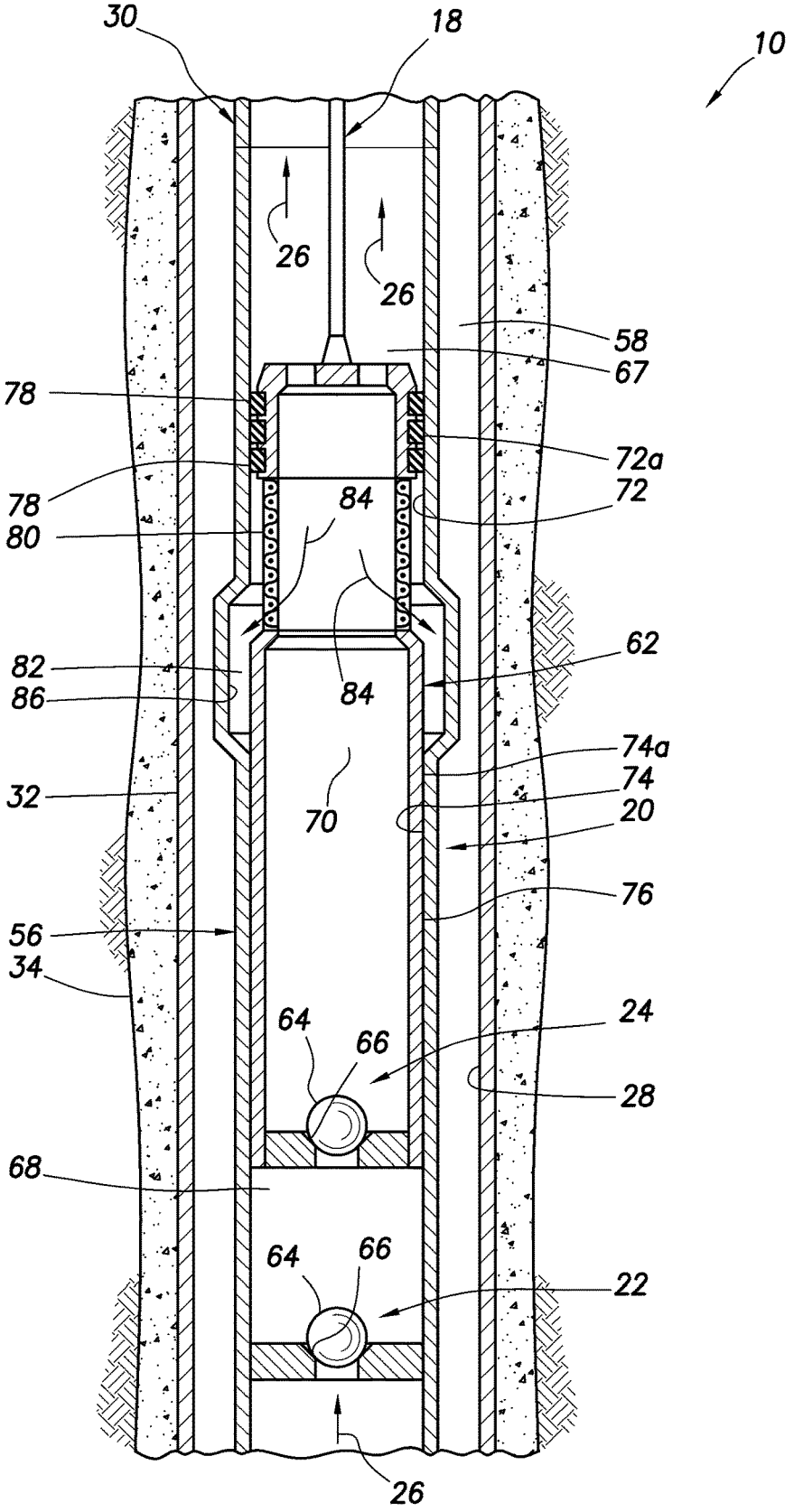
FIG. 2 is a representative partially cross-sectional view of a subsurface pump as used with the system and method of FIG. 1, the subsurface pump embodying the principles of this disclosure.

Referring additionally now to FIG. 2, a more detailed view of an example of the subsurface pump 20 as used in the system 10 and method of FIG. 1 is representatively illustrated. Note, however, that the subsurface pump 20 may be used in other systems and methods, in keeping with the principles of this disclosure.

As depicted in FIG. 2, the subsurface pump 20 is connected at a lower or distal end of the tubing string 30 for enhanced clarity of illustration. However, the subsurface pump 20 would more typically be received in the tubing string 30 (as depicted in FIG. 1) and releasably secured therein (for example, using a latch or anchor (not shown) of the type well known to those skilled in the art), for convenient installation and retrieval of the pump 20 separately from the tubing string 30.

In the FIG. 2 example, the standing valve 22 is positioned near a lower or distal end of a barrel 56 of the subsurface pump 20. The barrel 56 is connected to the tubing string 30.

An annulus 58 is formed radially between the barrel 56 and the casing 32. In examples where the barrel 56 is received within the tubing string 30, the annulus 58 may be formed radially between the casing 32 and the tubing string 30 surrounding the subsurface pump 20.

The traveling valve 24 is positioned at a lower or distal end of a plunger 62 received in the barrel 56. The plunger 62 is connected to the rod string 18 for reciprocating displacement therewith.

Each of the standing and traveling valves 22, 24 depicted in FIG. 2 includes a ball 64 that can sealingly engage an annular seat 66 to allow only one-way flow through the valve. However, in other examples, other types of check valves or other types of flow control devices may be used for the standing and traveling valves 22, 24. Thus, the scope of this disclosure is not limited to any particular configurations of the standing and traveling valves 22, 24.

A compression chamber 68 is formed longitudinally between the standing and traveling valves 22, 24 in an interior flow passage 67 of the barrel 56. Similar to that described above for the FIG. 1 subsurface pump 20, when the rod string 18 and plunger 62 displace upward (as viewed in FIG. 2), the traveling valve 24 is closed, the fluid 26 in the tubing string 30 is displaced upward (toward the surface) by the plunger 62, the standing valve 22 opens, and the fluid 26 flows into the compression chamber 68 from the wellbore 28. When the rod string 18 and plunger 62 displace downward (as viewed in FIG. 2), the standing valve 22 closes, the traveling valve 24 opens, and fluid 26 in the compression chamber 68 flows into an interior flow passage 70 of the plunger 62.

A gas interference or gas-lock condition can occur if gas is entrained with the fluid 26. The gas can accumulate in the compression chamber 68, until the gas volume cannot be sufficiently compressed by the plunger 62 to overcome hydrostatic pressure in the tubing string 30, in order to flow the fluid 26 from the compression chamber 68 to the plunger interior flow passage 70 (the traveling valve 24 opens in response to pressure in the compression chamber 68 being greater than pressure in the plunger interior flow passage 70).

However, the subsurface pump 20 includes features that enable a gas interference or gas-lock condition to be prevented, or at least mitigated. Accumulation of gas in the compression chamber 68 can be reduced, so that pressure in the chamber 68 can be increased sufficiently to overcome hydrostatic pressure in the tubing string 30, and so that the gas can be flowed to the surface with the fluid 26.

To induce flow of the fluid 26 in response to reciprocation of the plunger 62 in the barrel 56, the plunger 62 is closely fitted in bores 72, 74 formed in the barrel 56. This configuration of the plunger 62 and barrel 56 is sufficient to allow a pressure differential to be sustained across an annular interface 76 between the barrel 56 and the plunger 62 when the plunger 62 is displaced longitudinally relative to the barrel 56.

The plunger 62 carries a set of annular seals or wipers 78 near an upper end thereof for engagement with the upper bore 72 in the barrel 56. The wipers 78 prevent debris and particulates in the tubing string 30 from displacing into the annular interface 76 between the plunger 62 and barrel 56. A pressure differential may be created across the wipers 78 when the plunger 62 reciprocates in the barrel 56, but in this example any such pressure differentials are minimal (e.g., in order to desirably reduce wear of the wipers 78).

A filter 80 prevents debris and particulates from entering the annular interface 76 from the plunger interior flow passage 70, while also substantially equalizing pressure across the wipers 78. The filter 80 may comprise any suitable type of filtering medium for excluding debris and particulates from well fluids (such as, wire-wrapped, sintered, pre-packed, slotted, perforated and other types of filtering mediums).

The filter 80 in the FIG. 2 example is connected in the plunger 62 longitudinally between the wipers 78 and the traveling valve 24, but the filter 80 could be otherwise positioned in other examples. The filter 80 reciprocates with the plunger 62 relative to a fluid chamber 82 formed in the barrel 56. A liquid 84 (which may be a liquid component of the fluid 26) can flow from the tubing string 30 and the plunger interior flow passage 70 to the fluid chamber 82 via the filter 80, as described more fully below.

As depicted in FIG. 2, the plunger 62 is relatively closely fitted in the lower bore 74 (e.g., a radial clearance between the plunger 62 and bore 74 is relatively small, perhaps on the order of ~150 to 200 microns), so that flow through the annular interface 76 is substantially restricted, allowing a pressure differential to be sustained across the annular interface 76 as the plunger 62 displaces relative to the barrel 56. In some examples, seals, wipers or other devices may be utilized to enhance the pressure differential-sustaining capability of the annular interface 76, to exclude debris, etc. Surface profiles (such as, ridges, grooves, surface roughness, etc.) may be used on the plunger 62 or barrel 56 to enhance turbulence or otherwise increase restriction to flow through the annular interface 76. Thus, the scope of this disclosure is not limited to any particular technique or configuration for substantially restricting flow between the barrel 56 and the plunger 62.

Note that the fluid chamber 82 is positioned longitudinally between two positions at which flow between the barrel 56 and the plunger 62 is substantially restricted. A first such longitudinal position 72*a* is at a sliding interface between the upper bore 72 and the wipers 78 as viewed in FIG. 2. A second such longitudinal position 74*a* is at a sliding interface between the plunger 62 and the lower bore 74 as viewed in FIG. 2 (e.g., at the annular interface 76 in the FIG. 2 example).

The fluid chamber 82 in the FIG. 2 example comprises an interior radially enlarged section 86 positioned longitudinally between the bores 72, 74. The fluid chamber 82 in this example is annular-shaped and outwardly circumscribes the filter 80 in some longitudinal positions of the plunger 62 relative to the barrel interior flow passage 67. However, in other examples, the fluid chamber 82 may not be positioned longitudinally between the bores 72, 74, may not be annular-shaped, may not be disposed between the positions 72*a*, 74*a*, or may not circumscribe the filter 80. Thus, the scope of this disclosure is not limited to any particular configuration of the fluid chamber 82 or its relationship to the filter 80.

The filter 80 filters fluid flowing between the fluid chamber 82 and the plunger interior flow passage 70. As mentioned above, the liquid 84 can pass through the filter 80 from the passage 70 to the fluid chamber 82.

Flow can also pass through the filter 80 in an opposite direction in this example. Such flow from the fluid chamber 82 into the interior of the plunger 62 via the filter 80 can act to clean the filter 80 of any accumulated particulates.

The filter 80 prevents particulates from passing into the fluid chamber 82 and the annular interface 76 between the barrel 56 and the plunger 62. Particulates excluded from the liquid 84 by the filter 80 instead flow to the surface with the fluid 26 via the tubing string 30.

Figure 3A:
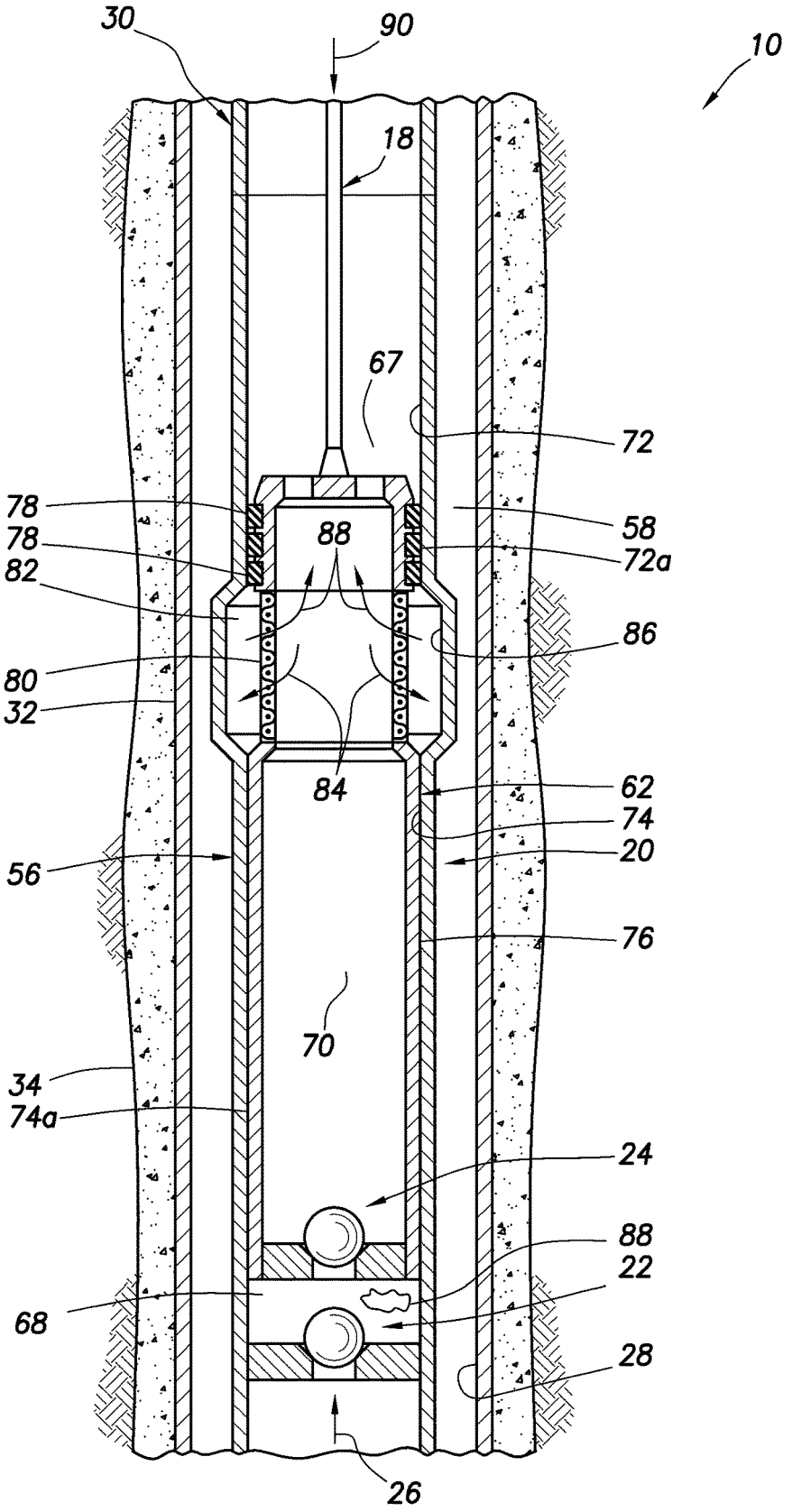
FIGS. 3A-C are representative partially cross-sectional views of the subsurface pump in a succession of operational stages.
Figure 3B:
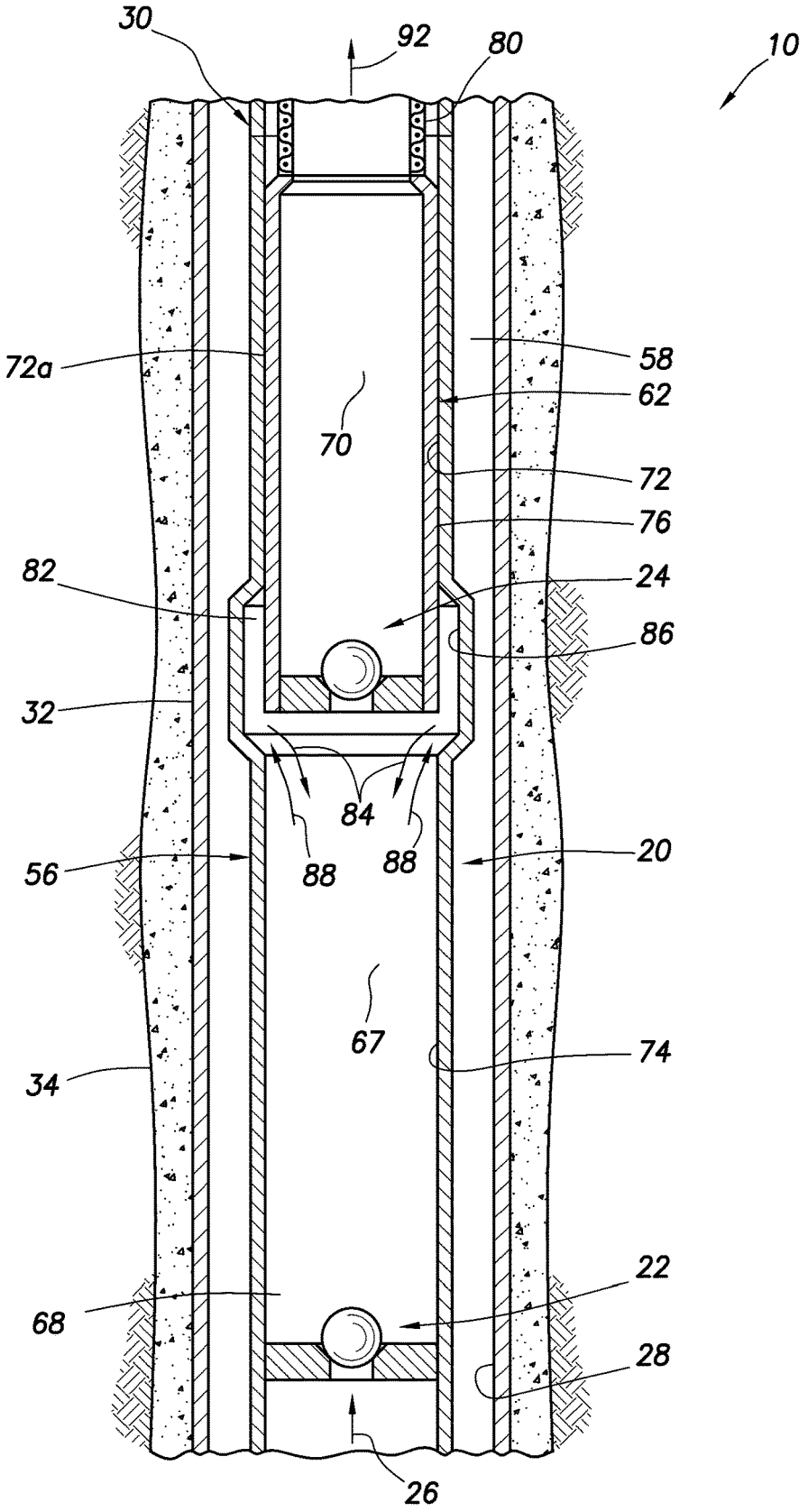
Figure 3C:
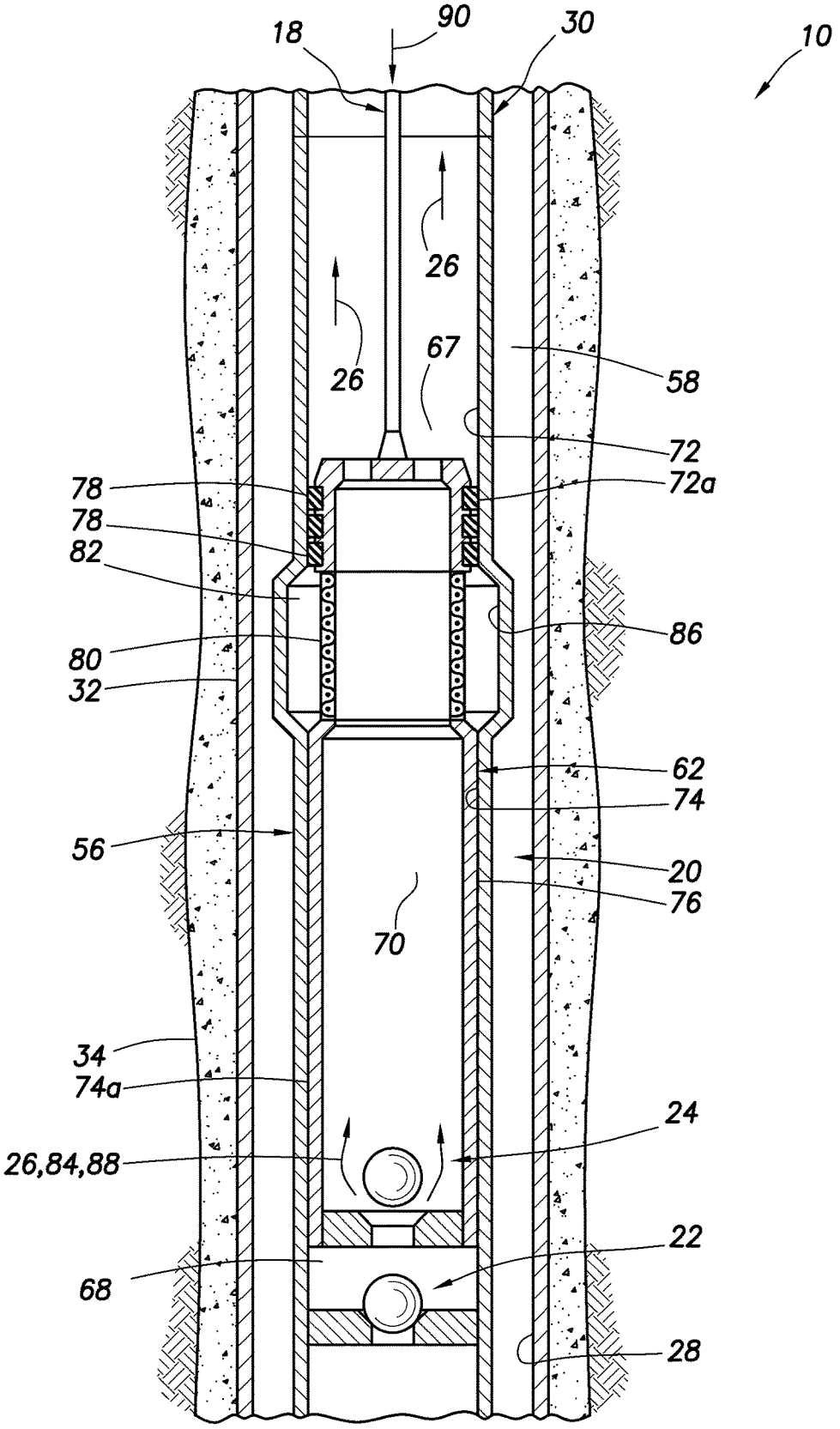

Referring additionally now to FIGS. 3A-C, the subsurface pump 20 is representatively illustrated in an example succession of operational stages. The depicted operational stages demonstrate how the subsurface pump 20, as used in the FIG. 1 system 10 and method, can prevent or at least mitigate a gas interference or gas-lock condition. However, it should be clearly understood that the principles of this disclosure do not require that a gas interference or gas-lock condition be produced, or that the subsurface pump 20 be operated as depicted in FIGS. 3A-C or as described herein.

In the well pumping system 10 as depicted in FIG. 3A, a gas-lock condition exists in the subsurface pump 20. A gas 88 has accumulated in the compression chamber 68.

When the plunger 62 is displaced in a longitudinally downward direction 90 (as viewed in FIG. 3A), the pressure of the gas 88 and any other fluid 26 also in the compression chamber 68 cannot be increased sufficiently to overcome the hydrostatic pressure in the tubing 30 and the plunger interior flow passage 70. Note that the traveling valve 24 remains closed as viewed in FIG. 3A, such that the gas 88 and any fluid 26 in the compression chamber 68 cannot flow to the plunger interior flow passage 70.

However, the liquid 84 in the flow passage 70 can flow through the filter 80 and into the fluid chamber 82. In some examples, it is also possible that any gas 88 in the fluid chamber 82 can also flow from the fluid chamber 82 to the plunger interior flow passage 70 via the filter 80. In this manner, the gas 88 can be produced with the fluid 26 through the tubing string 30 to the surface.

As viewed in FIG. 3A, the filter 80 is disposed between the two flow restricting positions 72*a*, 74*a*, and the plunger 62 is at or near its lower stroke extent. The fluid chamber 82 outwardly surrounds the filter 80 and receives the filtered liquid 84 from the filter 80.

In other examples, the fluid chamber 82 may not outwardly surround the filter 80 at or near the lower stroke extent of the plunger 62, or it may not be necessary for the filter 80 to be disposed in any particular relationship to the flow restricting positions 72, 74*a*. Thus, the scope of this disclosure is not limited to any particular details of the operation depicted in FIGS. 3A-C.

In FIG. 3B, the subsurface pump 20 is depicted after the plunger 62 has displaced to or near its upper stroke extent (in a longitudinally upward direction 92 as viewed in FIG. 3B). A lower end of the plunger 62 is now positioned above a lower end of the fluid chamber 82, so that the plunger 62 only partially blocks the fluid chamber 82, and the plunger 62 is withdrawn from the bore 74. In other examples, the plunger 62 could remain received in the bore 74, and communication between the fluid chamber 82 and the compression chamber 68 could be provided by other means (such as, by an opening or other passage formed through a wall of the plunger 62).

In the FIG. 3B configuration, the liquid 84 can now flow from the fluid chamber 82 into the compression chamber 68. In addition, in some examples, the gas 88 in the compression chamber 68 can flow into the fluid chamber 82 (the gas 88 being less dense than the liquid 84 or any fluid 26 also in the compression chamber 68).

Note that, with the plunger 62 in its FIG. 3B position, the flow restricting position 72*a* is now disposed longitudinally between the filter 80 and the traveling valve 24 and the fluid chamber 82. Thus, flow is substantially prevented from the plunger interior flow passage 70 to the compression chamber 68, as it expands due to displacement of the plunger 62 in the upward direction 92. Instead, if pressure in the compression chamber 68 reduces sufficiently (due to expansion of the compression chamber 68 as the plunger 62 displaces in the upward direction 92), the standing valve 22 can open and permit some flow of the fluid 26 from the wellbore 28 into the compression chamber 68.

Whether or not any of the fluid 26 flows into the compression chamber 68 on the upward stroke of the plunger 62, a gas/liquid ratio in the compression chamber 68 is reduced by the addition of the liquid 84 to the compression chamber 68, and by the flow of some or all of the gas 88 from the compression chamber 68 to the fluid chamber 82. Since the gas/liquid ratio in the compression chamber 68 is reduced, pressure in the compression chamber 68 will be increased upon a subsequent downward stroke of the plunger 62 to its lower stroke extent, as compared to the previous downward stroke of the plunger 62 (e.g., as depicted in FIG. 3A).

Reciprocation of the plunger 62 between its upper and lower stroke extents, in this example, will result in incremental decreases in the gas/liquid ratio in the compression chamber 68. These incremental decreases in the gas/liquid ratio will result in corresponding incremental increases in the pressure in the compression chamber 68 when the plunger 68 at its lower stroke extent. Eventually, pressure in the compression chamber 68 increases sufficiently to cause the traveling valve 24 to open, and the fluids (e.g., gas 88, fluid 26 and liquid 84) to flow from the compression chamber 68 to the plunger interior flow passage 70.

In FIG. 3C, the subsurface pump 20 is depicted after the plunger 62 has displaced in the downward direction 90 to its lower stroke extent, and after pressure in the compression chamber 68 has increased sufficiently to cause the traveling valve 24 to open. The fluid 26, liquid 84 and any gas 88 in the compression chamber 68 can flow into the plunger interior flow passage 70 for production to the surface, as described above.

Any gas 88 in the fluid chamber 82 can flow into the flow passage 70 via the filter 80, and liquid 84 can flow into the fluid chamber 82 via the filter 80, as depicted in FIG. 3A. Thus, a regular periodic transfer of gas 88 to the flow passage 70 via the filter 80, and a regular periodic transfer of liquid 84 to the fluid chamber 82, is accomplished as the plunger 62 reciprocates in the barrel 56. In addition, flow from the fluid chamber 82 into the flow passage 70 via the filter 80 can help to remove any particulates that may have previously accumulated in the filter 80.

Although an incremental increase in compression chamber 68 pressure is described above for progressing from a gas-locked condition to a restoration of pumping capability, in some examples no more than one reciprocation of the plunger 62 may be needed to transfer sufficient gas 88 from the compression chamber 68 to restore pumping capability. Furthermore, use of the subsurface pump 20 can prevent a gas-locked condition from occurring, for example, by periodically transferring liquid 84 into the compression chamber 68 and transferring gas 88 out of the compression chamber 68, so that the gas/liquid ratio remains at a low enough level that the traveling valve 24 opens on each downward stroke. The periodic transfer of liquid 84 into the compression chamber 68 and gas 88 out of the compression chamber 68 can also prevent or mitigate occurrence of a gas interference condition.

It may now be fully appreciated that the above disclosure provides significant advancements to the arts of constructing and operating well artificial lift systems. In examples described above, the subsurface pump 20 can operate effectively to pump the fluid 26 from the well, even though gas 88 and particulates may be present in the fluid 26.

More specifically, the above disclosure provides to the art a subsurface pump 20 for use in well artificial lift operations. In one example, the subsurface pump 20 can include a barrel 56 having a standing valve 22 that controls flow through an interior flow passage 67 of the barrel 56, and a plunger 62 reciprocably received in the barrel 56 to first and second opposite stroke extents. At the first stroke extent (e.g., as depicted in FIG. 3A), flow being substantially restricted between the plunger 62 and the barrel 56 at first and second spaced apart positions 72*a*, 74*a* longitudinally along the barrel 56, and an interior flow passage 70 of the plunger 62 being in communication via a filter 80 with a fluid chamber 82 disposed longitudinally between the first and second positions 72*a*, 74*a*. At the second stroke extent (e.g., as depicted in FIG. 3B) the fluid chamber 82 being in communication with the compression chamber 68 and the standing valve 22.

At the second stroke extent, the first position 72*a* may be disposed longitudinally between the filter 80 and the fluid chamber 82.

The fluid chamber 82 may comprise an interior radially enlarged section 86 of the barrel 56.

At the first stroke extent, liquid 84 may flow from the plunger interior flow passage 70 to the fluid chamber 82 via the filter 80. At the second stroke extent, the liquid 84 may flow from the fluid chamber 82 to the barrel interior flow passage 67.

At the second stroke extent, flow between the filter 80 and the fluid chamber 82 may be substantially restricted.

At the second stroke extent, the plunger 62 may extend only partially longitudinally across the fluid chamber 82.

The fluid chamber 82 may comprise an annular chamber that at least partially encircles the filter 80 at the first stroke extent.

A method of pumping a fluid 26 from a wellbore 28 is also provided to the art by the above disclosure. In one example, the method can include reciprocating a plunger 62 relative to a barrel 56 of a subsurface pump 20. The reciprocating step can comprise: a) displacing the plunger 62 in a first direction 90, thereby receiving liquid 84 into a fluid chamber 82 from a filter 80, the liquid 84 in the fluid chamber 82 having been filtered by the filter 80, and b) displacing the plunger 62 in a second direction 92 opposite to the first direction 90, thereby transferring the liquid 84 from the fluid chamber 82 to a compression chamber 68 in an interior flow passage 67 of the barrel 56.

The transferring step may include displacing the filter 80 in the second direction 92. The transferring step may include displacing the filter 80 upward relative to the fluid chamber 82.

The step of displacing the plunger 62 in the first direction 90 may include displacing the plunger 62 to a first stroke extent at which flow is substantially restricted between the plunger 62 and the barrel 56 at first and second spaced apart positions 72*a*, 74*a* longitudinally along the barrel 56, and an interior flow passage 70 of the plunger 62 is in communication via the filter 80 with the fluid chamber 82 disposed longitudinally between the first and second positions 72*a*, 74*a*.

The step of displacing the plunger 62 in the second direction 92 may include displacing the plunger 62 to a second stroke extent at which the fluid chamber 82 is in communication with the standing valve 22.

At the first stroke extent, the liquid 84 may flow from the plunger interior flow passage 70 to the fluid chamber 82 via the filter 80. At the second stroke extent, the liquid 84 may flow from the fluid chamber 82 to the barrel interior flow passage 67.

At the second stroke extent, flow between the filter 80 and the fluid chamber 82 may be substantially restricted (e.g., at the flow restricting position 72*a*).

Flow from the fluid chamber 82 to the plunger interior flow passage 70 via the filter 80 removes accumulated particulates (such as, sand, formation fines, proppant, etc.) from the filter 80. The flow may comprise liquid 84, gas 88, a combination of these, or other fluid compositions. The flow may be a result of turbulence as the plunger 62 displaces between the first and second stroke extents.

A well pumping system 10 is also provided to the art by the above disclosure. In one example, the system 10 can include an actuator 14 (such as, a hydraulic actuator, a walking-beam pump jack, an electrical or fueled actuator, etc.) that reciprocates a rod string 18, and a subsurface pump 20 that receives fluid 26 from a wellbore 28 and discharges the fluid 26 into a tubing string 30. The subsurface pump 20 can include a plunger 62 with a traveling valve 24, a barrel 56 with a standing valve 22, and a filter 80 that filters liquid 84 which flows from the tubing string 30 to a compression chamber 68 disposed longitudinally between the traveling valve 24 and the standing valve 22.

The filter 80 may reciprocate relative to a fluid chamber 82. In a first configuration of the subsurface pump 20, both of the filter 80 and the fluid chamber 82 are disposed longitudinally between first and second positions 72*a*, 74*a* at which flow between the plunger 62 and the barrel 56 is substantially restricted.

The first position 72*a* may be disposed longitudinally between the filter 80 and the fluid chamber 82 in a second configuration of the subsurface pump 20. The plunger 62 may only partially separate the fluid chamber 82 from the compression chamber 68 in the second configuration. Flow between the filter 80 and the fluid chamber 82 may be substantially restricted in the second configuration.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of pumping a fluid from a wellbore, the method comprising:

reciprocating a plunger relative to a barrel of a subsurface pump, the reciprocating comprising: a) displacing the plunger in a first direction, thereby receiving liquid into a fluid chamber from a filter positioned in a side wall of the plunger, the liquid in the fluid chamber having been filtered by the filter, and b) displacing the plunger in a second direction opposite to the first direction, thereby displacing the filter relative to the fluid chamber and transferring the liquid from the fluid chamber to an interior flow passage of the barrel, wherein the transferring comprises displacing the filter upward relative to the fluid chamber.

2. The method of claim 1, wherein the displacing the plunger in the first direction comprises displacing the plunger to a first stroke extent at which flow is substantially restricted between the plunger and the barrel at first and second spaced apart positions longitudinally along the barrel, and an interior flow passage of the plunger is in communication via the filter with the fluid chamber disposed longitudinally between the first and second positions.

3. The method of claim 2, wherein the displacing the plunger in the second direction comprises displacing the plunger to a second stroke extent at which the fluid chamber is in communication with a standing valve of the barrel.

4. The method of claim 3, wherein at the first stroke extent the liquid flows from the plunger interior flow passage to the fluid chamber via the filter, and at the second stroke extent the liquid flows from the fluid chamber to the barrel interior flow passage.

5. The method of claim 3, wherein at the second stroke extent flow between the filter and the fluid chamber is restricted.

6. The method of claim 1, wherein flow from the fluid chamber to the plunger interior flow passage via the filter removes accumulated particulates from the filter.

7. A method of pumping a fluid from a wellbore, the method comprising:

reciprocating a plunger relative to a barrel of a subsurface pump, the reciprocating comprising: a) displacing the plunger in a first direction, thereby receiving liquid into a fluid chamber from a filter, the liquid in the fluid chamber having been filtered by the filter, and b) displacing the plunger in a second direction opposite to the first direction, thereby transferring the liquid from the fluid chamber to an interior flow passage of the barrel, in which the filter filters fluid flow between a compression chamber of the plunger and the fluid chamber, and the fluid chamber comprises an interior radially enlarged section of the barrel.

8. The method of claim 7, wherein the transferring comprises displacing the filter in the second direction.

9. The method of claim 7, wherein the transferring comprises displacing the filter upward relative to the fluid chamber.

10. The method of claim 7, wherein the displacing the plunger in the first direction comprises displacing the plunger to a first stroke extent at which flow is substantially restricted between the plunger and the barrel at first and second spaced apart positions longitudinally along the barrel, and an interior flow passage of the plunger is in communication via the filter with the fluid chamber disposed longitudinally between the first and second positions.

11. The method of claim 10, wherein the displacing the plunger in the second direction comprises displacing the plunger to a second stroke extent at which the fluid chamber is in communication with a standing valve of the barrel.

12. The method of claim 11, wherein at the first stroke extent the liquid flows from the plunger interior flow passage to the fluid chamber via the filter, and at the second stroke extent the liquid flows from the fluid chamber to the barrel interior flow passage.

13. The method of claim 11, wherein at the second stroke extent flow between the filter and the fluid chamber is restricted.

14. The method of claim 7, wherein flow from the fluid chamber to the plunger interior flow passage via the filter removes accumulated particulates from the filter.

* * * * *